US006289899B1

(12) United States Patent
Giordano

(10) Patent No.: US 6,289,899 B1
(45) Date of Patent: Sep. 18, 2001

(54) KIT FOR HOLDING AND APPLYING NAIL PRIMER

(76) Inventor: Maryann Giordano, 14 Rolling Hills Dr., Nesconset, NY (US) 11767

( * ) Notice: Subject to any disclaimer, the term of this patent is extended or adjusted under 35 U.S.C. 154(b) by 0 days.

(21) Appl. No.: 09/476,170

(22) Filed: Dec. 30, 1999

(51) Int. Cl.[7] ..... A45D 29/00; A45D 28/18
(52) U.S. Cl. ..... 132/73.5; 132/73
(58) Field of Search ..... 132/73.5, 73, 286; 433/77

(56) References Cited

U.S. PATENT DOCUMENTS

| | | | | |
|---|---|---|---|---|
| D. 296,763 | | 7/1988 | Holmstadt et al. | D9/338 |
| D. 376,697 | | 12/1996 | Green et al. | D4/114 |
| D. 386,855 | | 11/1997 | Koptis | D32/45 |
| D. 388,545 | | 12/1997 | Antonopoulos-McIvor | D28/57 |
| D. 404,300 | | 1/1999 | Skobla | D9/338 |
| 2,563,315 | * | 8/1951 | Den Uyl | 132/73.5 |
| 2,579,450 | * | 12/1951 | Libson | 433/77 |
| 2,842,141 | * | 7/1958 | Rodrigues | 132/73.5 |
| 5,139,036 | * | 8/1992 | Pickard | 132/73.5 |
| 5,299,877 | | 4/1994 | Birden | 401/206 |
| 5,348,029 | * | 9/1994 | Rodriguez | 132/74.5 |
| 5,348,476 | * | 9/1994 | Cohen et al. | 433/220 |
| 5,388,597 | * | 2/1995 | Smith et al. | 132/73.5 |
| 5,862,811 | * | 1/1999 | Steele | 132/200 |
| 6,036,490 | * | 3/2000 | Johnsen et al. | 433/102 |

* cited by examiner

*Primary Examiner*—John J. Wilson
*Assistant Examiner*—Robyn Kieu Doan
(74) *Attorney, Agent, or Firm*—Richard L. Miller P.A.

(57) ABSTRACT

A kit for holding and applying nail primer. The kit includes a holder, an applicator, and an eye dropper. The holder rests on a surface. The applicator is replaceably attached to the holder and contains and applies the nail primer. The eye dropper is replaceably attached to the holder and fills the applicator with the nail primer.

13 Claims, 1 Drawing Sheet

FIG. 1
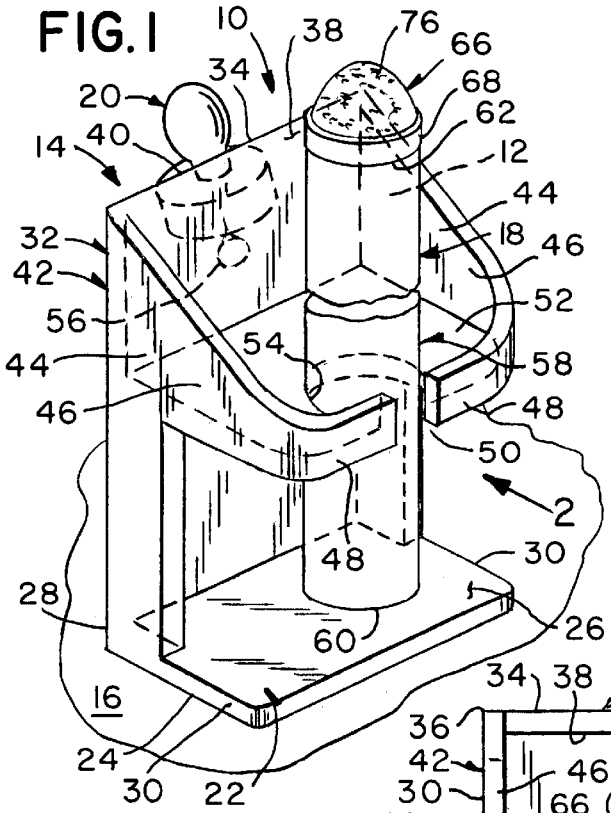
FIG. 2
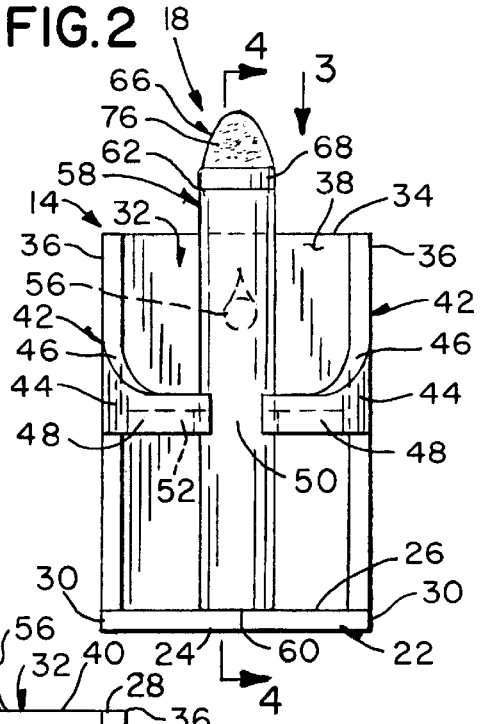
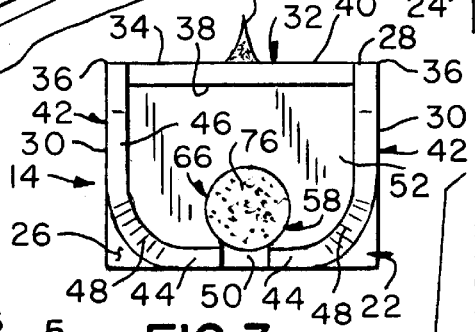
FIG. 3
FIG. 4
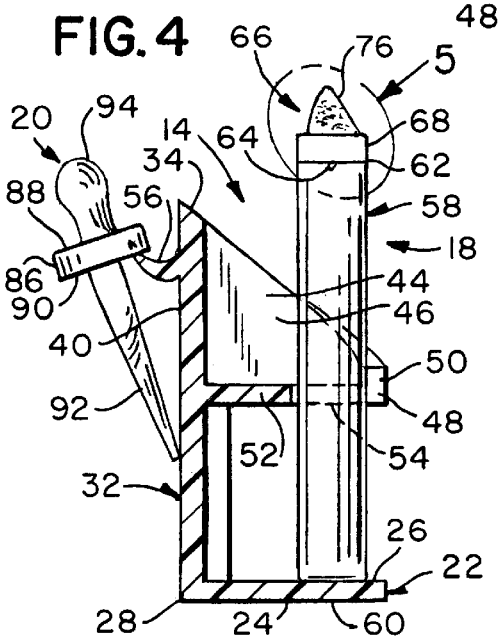
FIG. 5
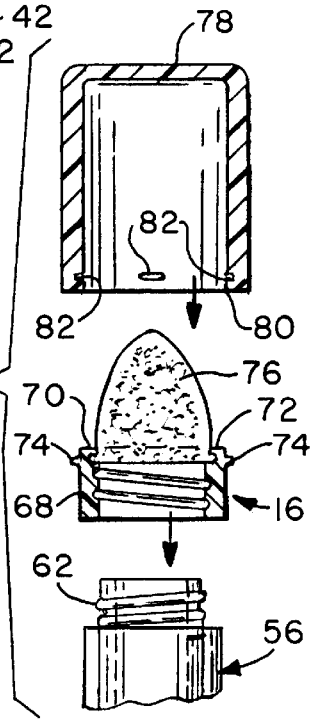

KIT FOR HOLDING AND APPLYING NAIL PRIMER

BACKGROUND OF THE INVENTION

1. Field of the Invention

The present invention relates to a kit. More particularly, the present invention relates to a kit for holding and applying nail primer.

2. Description of the Prior Art

Before a manicurist can apply acrylic nails, the nail bed must be primed with a liquid called primer. Most manicurist like to use the primer that is formulated for use with the same brand of acrylic powder and liquid.

Primer comes in a small glass jar and some may come with their own brushes. What is a problem is that the small primer bottle most always spills. Now, the manicurist is not only out the primer that costs $12.00 and up for a ¼ oz. bottle, but the spilled primer smells and takes a long time for the smell to fade from the surface it touched.

Numerous innovations for applicators have been provided in the prior art that will be described. Even though these innovations may be suitable for the specific individual purposes to which they address, however, they differ from the present invention.

A FIRST EXAMPLE, U.S. Pat. No. Des. 296,763 to Holmstadit et al. teaches the ornamental design for a paint applicator or similar article.

A SECOND EXAMPLE, U.S. Pat. No. Des. 376,697 to Green et al. teaches the ornamental design for a combined container and applicator.

A THIRD EXAMPLE, U.S. Pat. No. Des. 386,855 to Koptis teaches the ornamental design for a sponge applicator cap.

A FOURTH EXAMPLE, U.S. Pat. No. Des. 388,545 to Antonopoulos-McIvor teaches the ornamental design for a tool for use in removing nail polish from finger nails.

A FIFTH EXAMPLE, U.S. Pat. No. Des. 404,300 to Skobla teaches the ornamental design for a lotion applicator.

A SIXTH EXAMPLE, U.S. Pat. No. 5,299,877 to Birden teaches an applicator for coating materials, such as shoe polish, that is made with a relatively rigid open cell foam coating pad. The foam has an average of from 12 to 25 pores per linear centimeter with an average pore size being from 0.4 to 2 microns. The pad rigidity can be provided by a hard material per se or by having a flexible porous foam material compressed from its original volume to from 1/10th to 1/20th its original volume. The coating pad has less than a 20% compression when subjected to a 400 gm/cm2 pressure. The coating pad can be used with a pigmented coating material or polish with an average particle size of from 0.4 to 1 micron.

It is apparent that numerous innovations for applicators have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a kit for holding and applying nail primer that avoids the disadvantages of the prior art.

ANOTHER OBJECT of the present invention is to provide a kit for holding and applying nail primer that is simple and inexpensive to manufacture.

STILL ANOTHER OBJECT of the present invention is to provide a kit for holding and applying nail primer that is simple to use.

BRIEFLY STATED, YET ANOTHER OBJECT of the present invention is to provide a kit for holding and applying nail primer. The kit includes a holder, an applicator, and an eye dropper. The holder rests on a surface. The applicator is replaceably attached to the holder and contains and applies the nail primer. The eye dropper is replaceably attached to the holder and fills the applicator with the nail primer.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention;

FIG. 2 is a reduced front elevational view taken generally in the direction of arrow 2 in FIG. 1;

FIG. 3 is a diagrammatic top plan view taken generally in the direction of arrow 3 in FIG. 2;

FIG. 4 is a diagrammatic cross sectional view taken on line 4—4 in FIG. 2; and FIG. 5 is an enlarged exploded diagrammatic view, in partial section, of the area generally enclosed in the dotted curve identified by arrow 5 in FIG. 4.

LIST OF REFERENCE NUMERALS UTILIZED IN THE DRAWING

10 kit of the present invention for holding and applying nail primer 12
12 nail primer
14 holder for resting on surface 16
16 surface
18 applicator for containing and applying nail primer 12
20 eye dropper for filling applicator 18 with nail primer 12
22 base of holder 14
24 lowermost surface of base 22 of holder 14 for resting on surface 16
26 uppermost surface of base 22 of holder 14
28 rearmost edge of base 22 of holder 14
30 pair of side edges of base 22 of holder 14
32 rear wall of holder 14
34 uppermost edge of rear wall 32 of holder 14
36 pair of sidemost edges of rear wall 32 of holder 14
38 frontmost surface of rear wall 32 of holder 14
40 rearmost surface of rear wall 32 of holder 14
42 pair of side walls of holder 14
44 pair of arms of holder 14
46 pair of first portions of pair of arms 44 of holder 14
48 pair of second portions of pair of arms 44 of holder 14
50 gap between pair of second portions 48 of pair of arms 44 of holder 14
52 shelf of holder 14
54 throughbore through shelf 52 of holder 14
56 hook of holder 14
58 tube of applicator 18 for holding nail primer 12
60 lowermost end of tube 58 of applicator 18

62 uppermost end of tube 58 of applicator 18
64 vent hole in uppermost end 62 of tube 58 of applicator 18
66 tip of applicator 18
68 collar of tip 66 of applicator 18
70 uppermost end of collar 68 of tip 66 of applicator 18
72 external periphery of uppermost end 70 of collar 68 of tip 66 of applicator 18
74 plurality of tabs extending radially outwardly from external periphery 72 of uppermost end 70 of collar 68 of tip 66 of applicator 18
76 pad of tip 66 of applicator 18 for applying nail primer 12 onto the nail bed
78 cap of applicator 18 for preventing drying out of nail primer 12 and hardening of pad 76 of tip 66 of applicator 18 when not in use
80 lowermost end of cap 78 of applicator 18
82 interior periphery of lowermost end 80 of cap 78 of applicator 18
84 plurality of recesses extending radially inwardly in interior periphery 82 of lowermost end 80 of cap 78 of applicator 18
86 cap of eye dropper 20
88 uppermost surface of cap 86 of eye dropper 20
90 lowermost surface of cap 86 of eye dropper 20
92 tube of eye dropper 20
94 nipple of eye dropper 20

DETAILED DESCRIPTION OF THE PREFERRED EMBODIMENT

Referring now to the figures, in which like numerals indicate like parts, and particularly to FIG. 1, the kit of the present invention is shown generally at 10 for holding and applying nail primer 12.

The overall configuration of the kit 10 can best be seen in FIG. 1, and as such, will be discussed with reference thereto.

The kit 10 comprises a holder 14 for resting on a surface 16, an applicator 18 replaceably attached to the holder 14 for containing and applying the nail primer 12, and an eye dropper 20 replaceably attached to the holder 14 for filling the applicator 18 with the nail primer 12.

The specific configuration of the holder 14 can best be seen in FIGS. 1–4, and as such, will be discussed with reference thereto.

The holder 14 is plastic.

The holder 14 comprises a base 22 that is planar, horizontally-oriented, and has a lowermost surface 24 for resting on the surface 16, an uppermost surface 26, a rearmost edge 213, land a pair of side edges 30.

The holder 14 further comprises a rear wall 32 that is planar, vertically-oriented, and extends upwardly from the rearmost edge 28 of the base 22 of the holder 14, to an uppermost edge 34 that is rearwardly-upwardly inclined.

The rear wall 32 of the holder 14 further has a pair of sidemost edges 36, a frontmost surface 38, and a rearmost surface 40.

The holder 14 further comprises a pair of side walls 42 that are planar, vertically-oriented, and extend upwardly from the pair of side edges 30 of the base 22 of the holder 14, respectively, to, and angle accordingly, the uppermost edge 34 of the rear wall 32 of the holder 14, and forwardly along the pair of sidemost edges 36 of the rear wall 32 of the holder 14 to slightly forwardly of the rear wall 32 of the holder 14.

The holder 14 further comprises a pair of arms 44 that are horizontally-oriented and are spaced above the base 22 of the holder 14.

The pair of arms 44 of the holder 14 have a pair of first portions 46 that are triangular-shaped and extend forwardly from the pair of side walls 42 of the holder 14, respectively, coplanarly to a distance of the base 22 of the holder 14, and upwardly angling accordingly to the uppermost edge 34 of the rear wall 32 of the holder 14.

The pair of arms 44 of the holder 14 further have a pair of second portions 48 that extend inwardly, towards, but short of each other, from the pair of first portions 46 of the pair of arms 44 of the holder 14, respectively, so as to form a gap 50 therebetween.

The holder 14 further comprises a shelf 52 that is planar, horizontally-oriented, and extends forwardly from, and contacts, frontmost surface 38 of the rear wall 32 of the holder 14, along, and contacts, the pair of first portions 44 of the pair of arms 42 of the holder 14, to, and contacts, the pair of second portions 48 of the pair of arms 42 of the holder 14 so as to form a web that prevents movement of the pair of arms 42 of the holder 14.

The shelf 52 of the holder 14 has a throughbore 54 that extends vertically therethrough, communicates with the gap 50 between the pair of arms 42 of the holder 14 so as to form a keyhole configuration, and replaceably holds the applicator 18.

The holder 14 further comprises a hook 56 that extends rearwardly from the rearmost surface 40 of the rear wall 32 of the holder 14, is disposed at an elevation that is between the pair of arms 42 of the holder 14 and the uppermost edge 34 of the rear wall 32 of the holder 14, equidistantly between the pair of sidemost edges 36 of the rear wall 32 of the holder 14, and replaceably suspends the eye dropper 20.

The specific configuration of the applicator 18 can best be seen in FIGS. 1–5, and as such, will be discussed with reference thereto.

The applicator 18 is transparent glass.

The applicator 18 comprises a tube 58 that is slender, elongated, passes replaceably into, and is held vertically in, the throughbore 54 in the shelf 52 of the holder 14 for holding the nail primer 12, and has a lowermost end 60 that is closed and rests upon the uppermost surface 26 of the base 22 of the holder 14 and an uppermost end 62 that is open, externally threaded, and has a vent hole 64.

The applicator 18 further comprises a tip 66 that comprises a collar 68 that is internally threaded so as to threadably receive the uppermost end 62 of the tube 58 of the applicator 18.

The collar 68 of the tip 66 of the applicator 18 has an uppermost end 70 with an external periphery 72.

The external periphery 72 of the uppermost end 70 of the collar 68 of the tip 66 of the applicator 18 has a plurality of tabs 74 that extend radially outwardly therefrom, and which are spaced diametrically apart from each other.

The tip 66 of the applicator 18 further comprises a pad 76 that is porous, substantially conically-shaped for conforming to the nail bed, extends coaxially from, and is captured in, the uppermost end 70 of the collar 68 of the tip 66 of the applicator 18, and fluidly communicates with the tube 58 of the applicator 18 for applying the nail primer 12 contained therein onto the nail bed.

The pad 76 of the tip 66 of the applicator 18 is rubber.

The applicator 18 further comprises a cap 78 that replaceably covers the pad 76 of the tip 66 of the applicator 18 for preventing drying out of the nail primer 12 and hardening of the pad 76 of the tip 66 of the applicator 18 when not in use.

The cap 78 of the applicator 18 is cylindrically-shaped, and has a lowermost end 80 that is open and has an interior periphery 82.

The interior periphery 82 of the lowermost end 80 of the cap 78 of the applicator 18 has a plurality of recesses 84 that extend radially inwardly therein, are spaced diametrically apart from each other, and releasably receive the plurality of tabs 74 on the external periphery 72 of the uppermost end 70 of the collar 68 of the tip 66 of the applicator 18, respectively so as to allow the cap 78 of the applicator 18 to be maintained on.

The specific configuration of the eye dropper 20 can best be seen in FIG. 4, and as such, will be discussed with reference thereto.

The eye dropper 20 comprises a cap 86 that is disk-shaped, and has an uppermost surface 88, and a lowermost surface 90 that is open so as to replaceably engage the hook 56 of the holder 14 when the eye dropper 20 is not in use.

The eye dropper 20 further comprises a tube 92 that depends coaxially from the lowermost surface 90 of the cap 86 thereof.

The eye dropper 20 further comprises a nipple 94 that extends coaxially from the uppermost surface 88 of the cap 86 thereof, and fluidly communicates with the tube 92 of the eye dropper 20.

It will be understood that each of the elements describer above, or two or more together, may also find a useful application in other types of constructions differing from the types described above.

While the invention has been illustrated and described as embodied in a kit for holding and applying nail primer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kit for holding and applying nail primer, comprising:

a) a holder for resting on a surface;

b) an applicator replaceably attached to said holder for containing and applying the nail primer; and c) an eye dropper replaceably attached to said holder for filling said applicator with the nail primer, wherein said holder comprises a base that is planar, horizontally-oriented, and has:

i) a lowermost surface for resting on the surface;

ii) an uppermost surface;

iii) a rearmost edge; and iv) a pair of side edges, wherein said holder further comprises a rear wall that is planar, vertically-oriented, and extends upwardly from said rearmost edge of said base of said holder, to an uppermost edge that is rearwardly-upwardly inclined, wherein said rear wall of said holder further has:

A) a pair of sidemost edges;

B) a frontmost surface; and

C) a rearmost surface, wherein said holder further comprises a pair of side walls that are planar, vertically-oriented, and extend upwardly from said pair of side edges of said base of said holder, respectively, to, and angle accordingly, said uppermost edge of said rear wall of said holder, and forwardly along said pair of sidemost edges of said rear wall of said holder, to slightly forwardly of said rear wall of said holder, wherein said holder further comprises a pair of arms that are horizontally-oriented and are spaced above said base of said holder, wherein said pair of arms of said holder have a pair of first portions that are triangular-shaped and extend forwardly from said pair of side walls of said holder, respectively, coplanarly to a distance of said base of said holder, and upwardly and angling accordingly to said uppermost edge of said rear wall of said holder, wherein said pair of arms of said holder further have a pair of second portions that extend inwardly, towards, but short of each other, from said pair of first portions of said pair of arms of said holder, respectively, so as to form a gap therebetween, wherein said holder further comprises a shelf that is planar, horizontally-oriented, and extends forwardly from, and contacts, said frontmost surface of said rear wall of said holder, along, and contacts, said pair of first portions of said pair of arms of said holder, to, and contacts, said pair of second portions of said pair of arms of said holder so as to form a web that prevents movement of said pair of arms of said holder, wherein said shelf of said holder has a throughbore that extends vertically therethrough, communicates with said gap between said pair of arms of said holder so as to form a keyhole configuration, and replaceably holds said applicator.

2. The kit as defined in claim 1, wherein said holder further comprises a hook that extends rearwardly from said rearmost surface of said rear wall of said holder, is disposed at an elevation that is between said pair of arms of said holder and said uppermost edge of said rear wall of said holder, equidistantly between said pair of sidemost edges of said rear wall of said holder, and replaceably supports said eye dropper.

3. The kit as defined in claim 1, wherein said applicator comprises a tube that is slender, elongated, passes replaceably into, and is held vertically in, said throughbore in said shelf of said holder for holding the nail primer, and has:

a) a lowermost end that is closed and rests upon said uppermost surface of said base of said holder; and b) an uppermost end that is open, externally threaded, and has a vent hole.

4. The kit as defined in claim 3, wherein said applicator further comprises a tip that comprises a collar that is internally threaded so as to threadably receive said uppermost end of said tube of said applicator.

5. The kit as defined in claim 4, wherein said collar of said tip of said applicator has an uppermost end with an external periphery.

6. The kit as defined in claim 5, wherein said external periphery of said uppermost end of said collar of said tip of said applicator has a plurality of tabs that extend radially outwardly therefrom, and which are spaced diametrically apart from each other.

7. The kit as defined in claim 6, wherein said tip of said applicator further comprises a pad that is porous, substantially conically-shaped for conforming to the nail bed, extends coaxially from, and is captured in, said uppermost end of said collar of said tip of said applicator, and fluidly communicates with said tube of said applicator for applying the nail primer contained therein onto the nail bed.

8. The kit as defined in claim 7, wherein said applicator further comprises a cap that replaceably covers said pad of said tip of said applicator for preventing drying out of the nail primer and hardening of said pad of said tip of said applicator when not in use.

9. The kit as defined in claim 8, wherein said cap of said applicator is cylindrically-shaped, and has a lowermost end that is open and has an interior periphery.

10. The kit as defined in claim 9, wherein said interior periphery of said lowermost end of said cap of said applicator has a plurality of recesses that extend radially inwardly therein, are spaced diametrically apart from each other, and releasably receive said plurality of tabs on said external periphery of said uppermost end of said collar of said tip of said applicator, respectively so as to allow said cap of said applicator to be maintained on.

11. The kit as defined in claim 2, wherein said eye dropper comprises a cap that is disk-shaped, and has:

a) an uppermost surface; and b) a lowermost surface that is open so as to replaceably engage said hook of said holder when said eye dropper is not in use.

12. The kit as defined in claim 11, wherein said eye dropper further comprises a tube that depends coaxially from said lowermost surface of said cap thereof.

13. The kit as defined in claim 12, wherein said eye dropper further comprises a nipple that extends coaxially from said uppermost surface thereof, and fluidly communicates with said tube of said eye dropper.

* * * * *